United States Patent [19]

Ray

[11] 4,056,022

[45] Nov. 1, 1977

[54] KNIFE GROWTH DETECTOR

[75] Inventor: Eric Thomas Ray, Andover, England

[73] Assignee: AMF Incorporated, White Plains, N.Y.

[21] Appl. No.: 759,316

[22] Filed: Jan. 13, 1977

[30] Foreign Application Priority Data

Feb. 19, 1976 United Kingdom ..... 6589/76

[51] Int. Cl.[2] ..... A24C 5/28; B26D 7/24; B26D 7/12

[52] U.S. Cl. ..... 83/62; 83/174; 83/677

[58] Field of Search ..... 83/62, 62.1, 677, 174

[56] References Cited

U.S. PATENT DOCUMENTS 2,910,103 10/1959 Schreiber ..... 83/62

*Primary Examiner*—J. M. Meister

*Attorney, Agent, or Firm*—George W. Price; Charles J. Worth

[57] ABSTRACT

In a tobacco cutting machine where tobacco is cut by knives mounted on a rotating drum, the knives are advanced as they are worn away. In order to prevent the knives being advanced too far, and becoming damaged by contact with other machine parts, a safety device is provided. This includes a blade positioned near the path of the knife edges to be struck by a knife if the latter is advanced too far. The resultant movement of the blade is amplified by a lever system and is used to trigger a microswitch in the cutter drum drive circuit, whereby when a knife is advanced too far the cutter drum is stopped. The advancing mechanism for the knives includes a ratchet device driven by pulses of compressed air via a piston and cylinder device.

8 Claims, 10 Drawing Figures

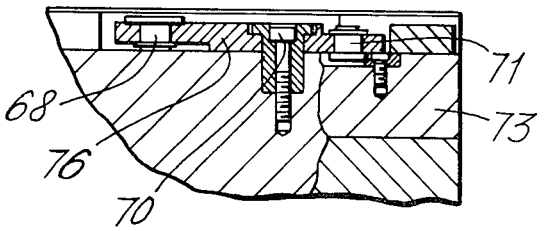
Fig.5.
Fig.8.
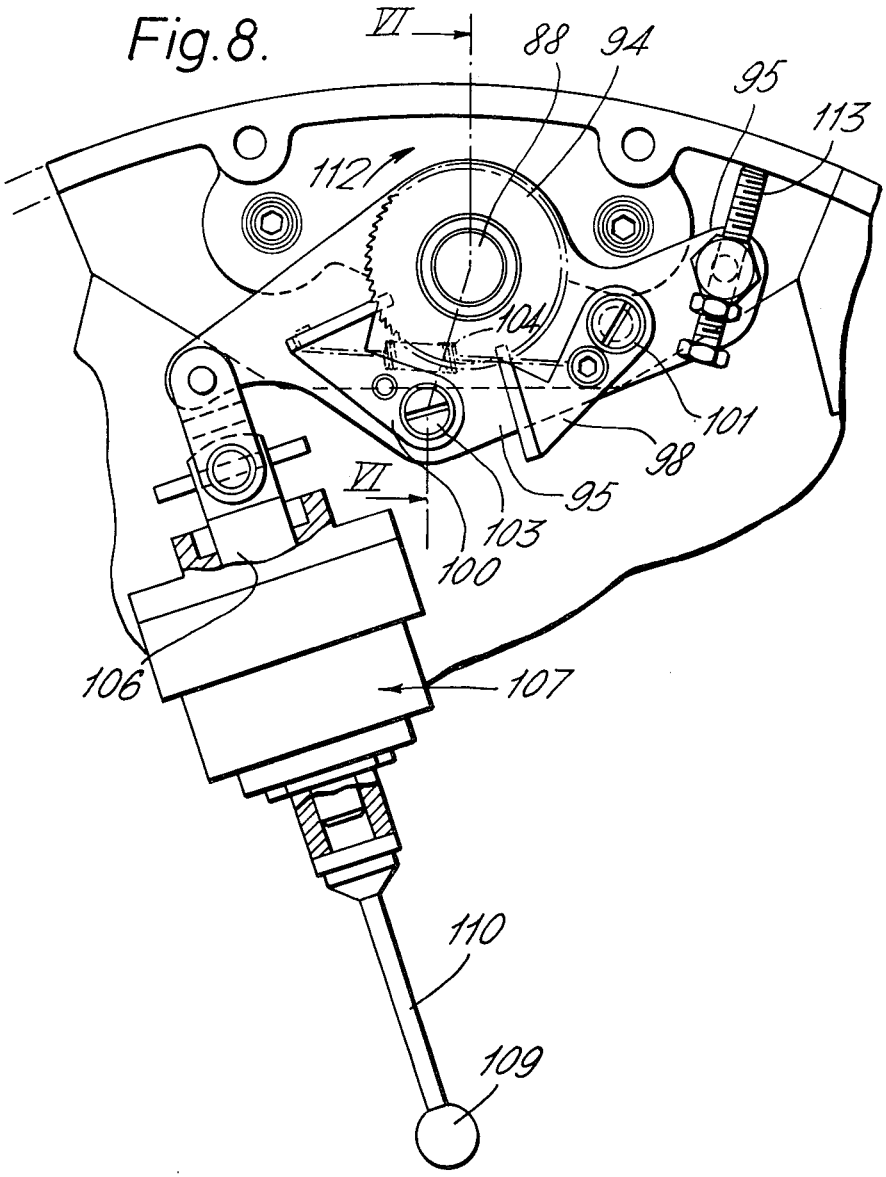

KNIFE GROWTH DETECTOR

BACKGROUND OF THE INVENTION

This invention relates to rotary cutting machines of the kind in which a large rotating drum which carries a series of knives cuts through a compressed material "cheese" (e.g. of tobacco) which is supported by a mouthpiece. The cutting knives are intermittently fed forward and continuously ground to maintain both a sharp knife edge and a consistent drum diameter because it is essential for good quality cutting that the cutting action takes place as close to the supporting mouthpiece as possible. The normal clearances between the knife tip and mouthpiece range from 0.006 inch – 0.015. inch It follows from the above that any increase in the effective cutting radius above 0.005 inch will put the cutting knives on a collision course with the stationary mouthpiece resulting in damage, expensive repairs and loss of production.

OBJECTIVES OF THE INVENTION

An object of the invention is to provide means of detecting knife growth which would eliminate damage and reduce downtime. It is important that any such device be simple in operation, easily checked, easily set, easily cleaned and of robust construction to be of permanent benefit in a production environment.

SUMMARY OF THE INVENTION

According to the invention there is provided in a cutting machine having a housing, a cutter drum mounted in the housing, a plurality of knives carried on said drum, means for rotating the cutter drum about its axis, means for feeding material to be cut to the cutter drum, means for grinding the knives to maintain a sharp knife edge, means for advancing the knives as they are worn away by the grinding means, a drum diameter being defined by the path of the knife edges as the cutter drum rotates, the provision of a detecting device to detect when a knife has been advanced beyond the cutter drum diameter, said device comprising:

- a movable support carried on said housing and movable into and out of a working position;
- a detector blade mounted on the movable support and having an edge positioned in proximity to the cutter drum diameter when the movable support is in its working position;
- a trip lever connected to the movable support;
- a latch mechanism mounted on the housing to retain the trip lever when the movable support is in its working position;
- a switch operated by the latch mechanism when the latch mechansim is disengaged by said trip lever; and
- circuit means for stopping rotation of the cutter drum when said switch means is operated, the arrangement being such that, in use, a knife which has been advanced beyond the cutter drum diameter strikes the detector blade thereby causing the movable support to move out of the working position and the latch mechanism to be disengaged by said trip lever.

Preferably the movable support is pivotally mounted between side plates of the housing. In such an embodiment, the detector blade has an edge lying in proximity to the cutter drum, the trip lever has an edge engaging the latch mechanism and the movable support is pivotable about a pivot axis parallel to the cutter drum axis and the distance between said detector blade edge and said pivot axis is less than the distance between said trip lever edge and said pivot axis.

Advantageously, the latch mechanism comprises an axially movable trip pin having a first end engaged by said trip lever when the movable support is in its working position, and a spring urging said trip pin into the engaged position. In this case the switch may have an operating arm in contact with a second end of the trip pin.

BRIEF DESCRIPTION OF THE DRAWINGS

The foregoing and other objects and advantages will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

FIG. 5 is a section taken on the line V — V in FIG. 4;

FIG. 8 shows the feed device shown in FIGS. 6 and 7 looking in the axial direction of the drum.

DESCRIPTION OF THE PREFERRED EMBODIMENT

Figure 1:
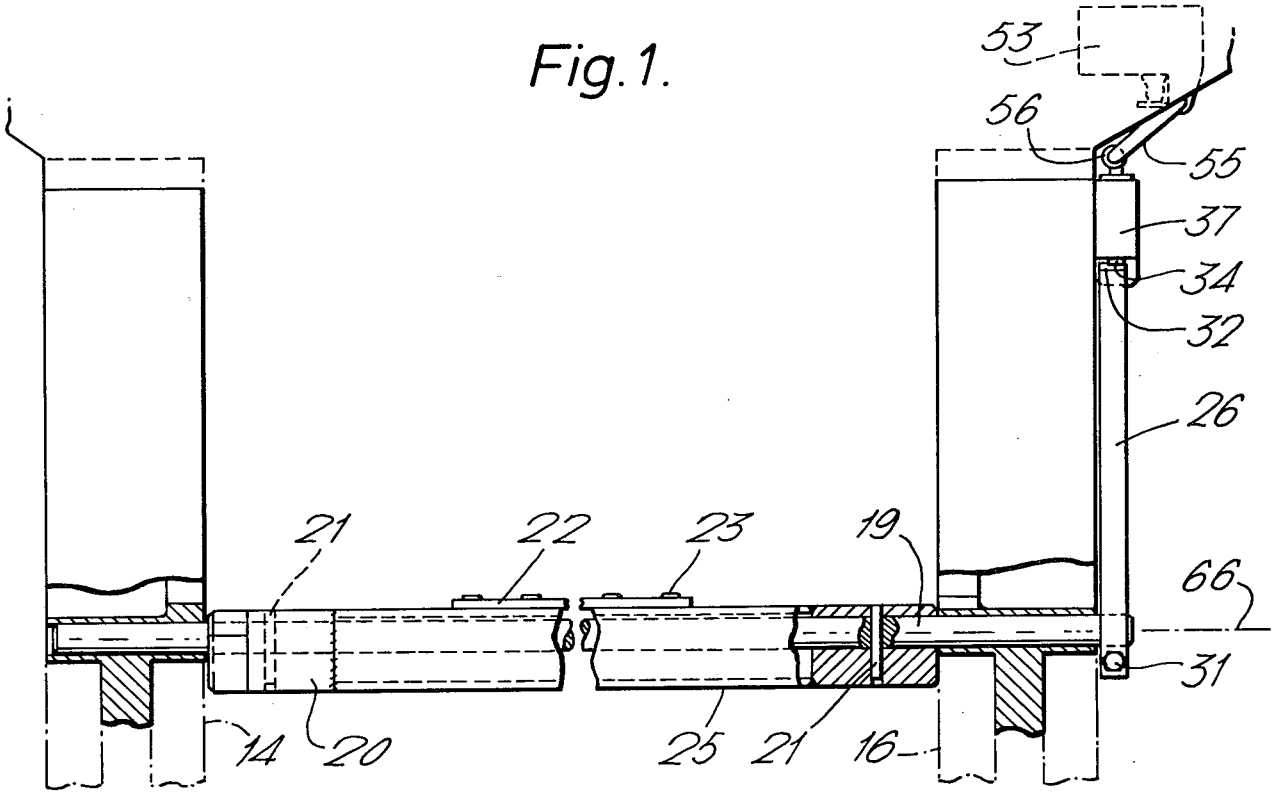
FIG. 1 is a front elevation of part of a cutting machine showing a detecting means according to the invention with the cutter drum removed.
Figure 2:
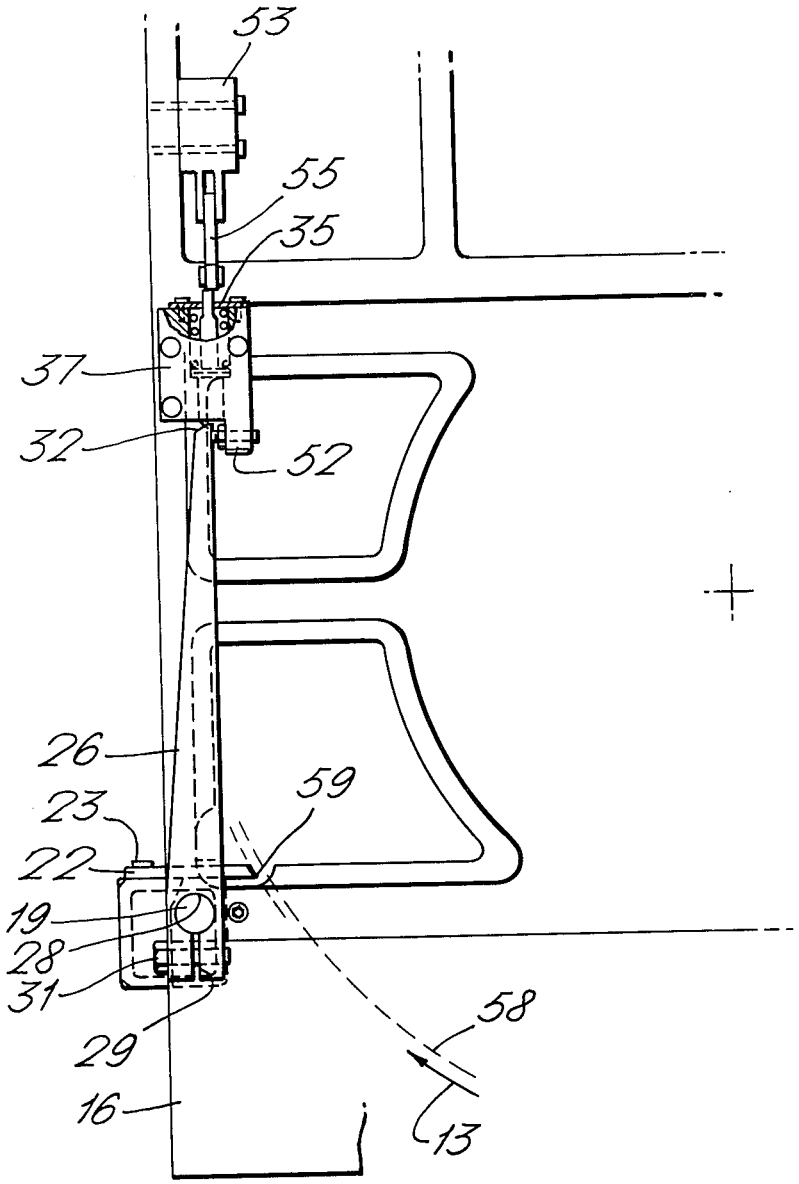
FIG. 2 is a side elevation of the detecting means shown in FIG. 1.
Figure 3:
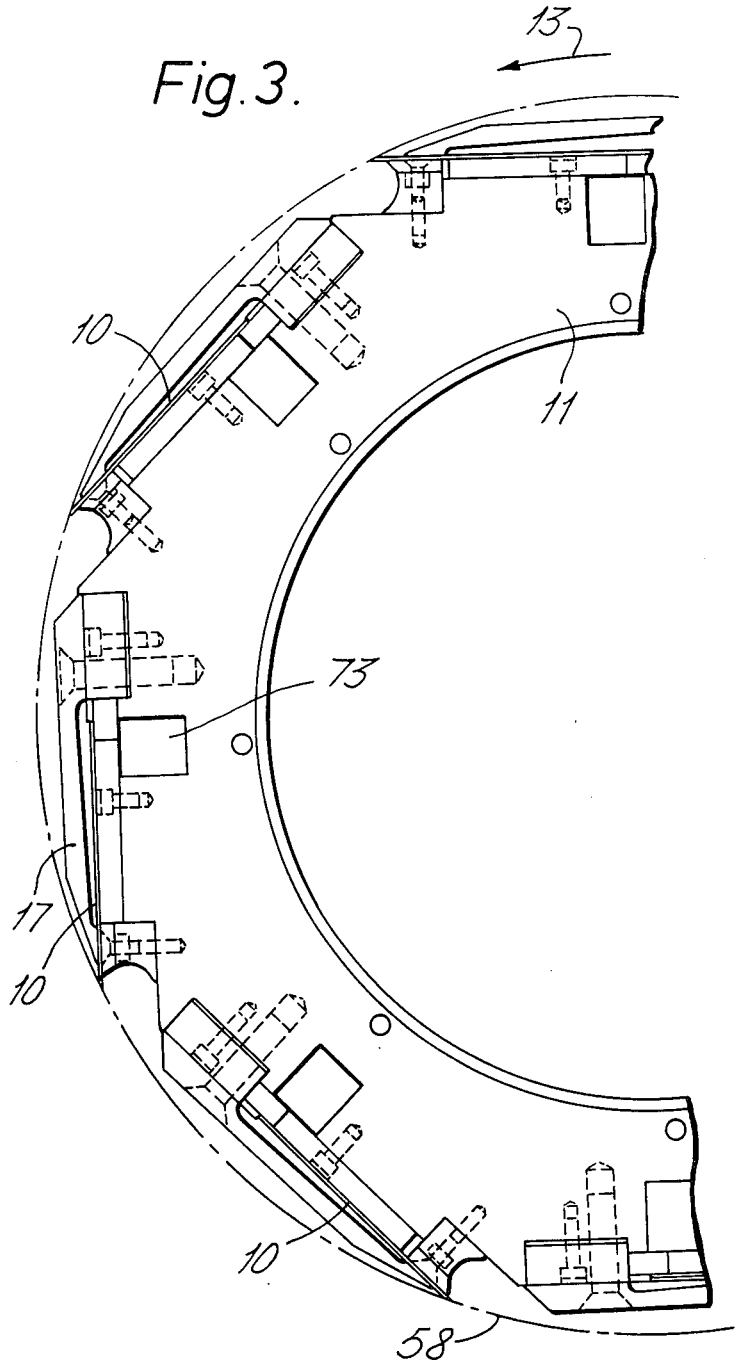
FIG. 3 shows a section through a cutter drum for use in connection with the detecting device of FIGS. 1 and 2.

Referring to FIGS. 1 to 3, the cutter drum assembly comprises a number of knives 10 carried on a drum 11 rotatable in the direction of the arrow 13. The drum 11 is mounted between left and right hand housing side walls 14, 16 respectively. Each knife is held in place by a knife gripper 17 screwed to the body of the drum 11.

The cutter drum forms part of a tobacco cutting machine in which conveyors feed tobacco through a mouthpiece to the cutter drum. The drum rotates at high speed, and the knives slice the tobacco. A grinding wheel is provided on a reciprocating carriage to regrind the knife edges as cutting continues, and therefore it is necessary at the end of each stroke of reciprocation of the carriage, for the knives 10, which are flat, to be fed in the direction of their own plane, so as to project slightly further from the drum and thus make up for wear, and also provide a small amount of material to be ground away during the next reciprocation of the grinding wheel, and thereby present a fresh sharp edge.

A rod 19 having its ends journalled in the left and right hand side walls 14, 16 of the cutting drum housing, has bosses 20 fixed thereto by pins 21. A movable support member in the form of a square sectioned tube 25 is welded at each end to the bosses 20. A detector blade 22 is attached by screws 23 to one side of the square sectioned tube 25 and when the latter is in its working position as shown the detector blade extends in a generally horizontal direction.

One end of the rod 19 extends through the side wall 16 and carries a trip lever 26. The trip lever has an aperture 28 for accommodating said end of the rod 19, communicating with an open slot 29. A clamping screw 31 passes through thr trip lever 26 between the aperture 28 and the adjacent end, and is tightened to secure the trip lever against rotation on the rod 19. The lever 26 extends upwardly and terminates in an oblique face 32 whereby the lever acts as a detent which engages a latch mechanism having a trip pin 34 loaded downwardly by a spring 35 and enclosed within a hollow support block 37 mounted on the housing side wall 16.

Figure 9:
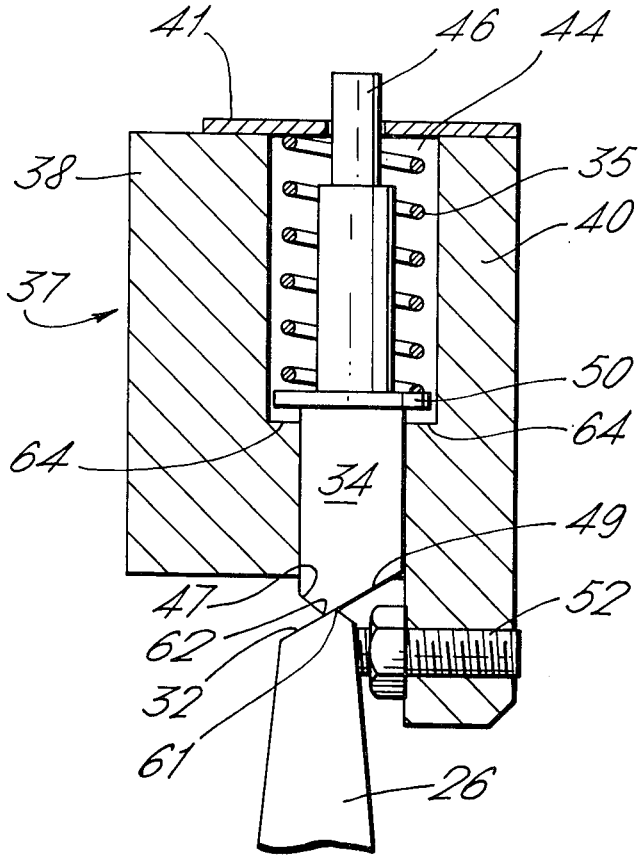
FIG. 9 shows a sectional view through the latch mechanism shown in FIG. 1.

As may be seen from FIGS. 2 and 9, the support block 37 has a top plate 41 and defined within the support block a channel 44 accommodating the axially movable trip pin 34, the upper end 46 of which extends through the top plate 41 and the lower end of which is formed with two oblique surfaces 47, 49. A shoulder 50 is non-axially movably mounted on the trip pin 34 and abuts one end of the compression spring 35, the other end of which is supported against the top plate 41. The trip pin is thus urged in a downwards direction relative to the support block 37.

The side 40 of the support block extends downwardly below the lower end of the other side 38 and carries a stop screw 52.

The trip pin 34 is urged against the detent 32 of the trip lever 26 to press the latter against the stop screw 52 and thus is prevented from moving further downwards relative to the support block.

Mounted on the housing side wall 16, above the support block 37, is a microswitch 53 having an actuating arm 55 the end of which remote from the switch carries a roller 56. The roller 56 is urged by a spring (not shown) mounted in the microswitch 53 into constant contact with the upper end 46 of the trip pin 34.

The edge of the blades 10, when adjusted as desired, move along a path defining the cutter drum diameter shown in FIGS. 2 and 3 by the line 58. The detector blade 22 has a bevelled end 59 which, in the working position, lies between 0.005 inch and 0.006 inch from the cutter drum diameter 58 of the knife edges.

When the cutter drum is in operation, any increase in cutting radius above 0.005 inch will cause the offending blade to strike the detector blade 22 and cause the latter to pivot about the axis of the rod 19. The upper end of the trip lever is thus moved away from the stop screw 52 and presses the trip pin 34 upwards against the force of the spring 35. Further deflection of the detector blade 22 results in the upper edge 61 of the detent 32 passing beyond the edge 62 defined by the faces 47, 49 of the trip pin enabling the trip pin to move downwards.

The face 47 of the trip pin then pushes against the detent 32 to force the latter to pivot further about the axis of the rod 19, moving the detector blade 22 out of the path of the cutting blades 10, thereby preventing the detector blade from damaging the cutting blades. The trip pin 34 continues to move downwards until the shoulder 50 strikes stop face 64 formed on the support block and as the roller 56 carried on the switch actuating arm 55 is spring biased against the trip pin end 46, the switch actuating arm 55 is also caused to move in such a manner as to operate the switch 53.

The switch 53 is connected in a safety circuit (FIG. 10), the arrangement being such that operation of the switch 53 as described above causes the drive to the cutter drum to be disconnected. The cutter drum thus ceases to rotate preventing damage to whichever cutter blade or blades have been advanced too far.

Because the bevelled end 59 of the detector blade 22 is considerably closer to the pivot axis 66 of the rod 19 than the detent 32, any movement of the detector blade is magnified at the detent, thereby increasing the sensitivity of operation of the safety mechanism.

To reset the device to its operating position once the blades on the cutter drum have been correctly positioned, the lever 26 is pushed manually back to its vertical position, pushing the trip lever 34 upwards in the process. Further movement of the lever 26 results in the upper edge 61 of the detent 32 passing beyond the edge 62 defined by the trip pin faces 47, 49 enabling the trip pin to move downwardly to retain the lever 26 in a position defined by the stop screw 52. The detector blade 21 is then in its operative position, spaced the required distance from the line 58 of the cutter blades.

To clean the detector blade tip the trip lever is pulled out by hand to a position where the detector blade tip can be satisfactorily cleaned. Resetting is achieved by simply pushing the trip lever back into the latch mechanism.

Figure 4:
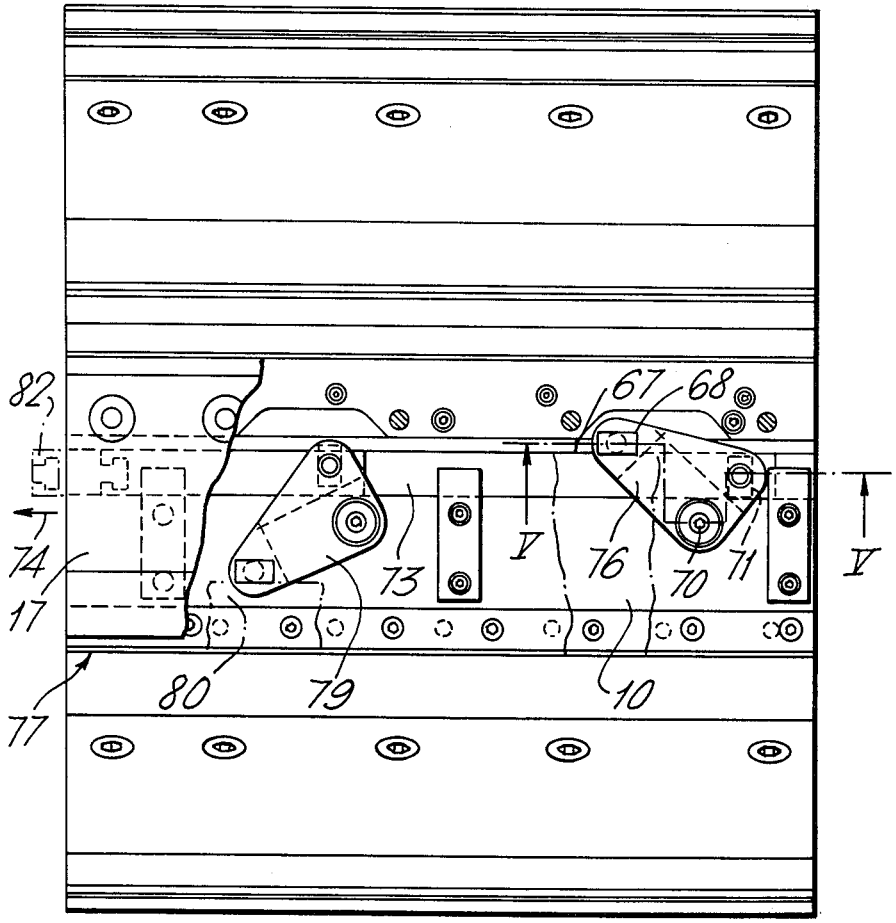
FIG. 4 shows a view of the cutter drum shown in FIG. 3, in the radial direction partly cut-away.

Referring to FIGS. 4 and 5, the knife 10, lying under the knife gripper 17 has its rear edge 67 abutted by a tappet 68 mounted on a tappet lever 76. The tappet lever is pivotally mounted at 70 and also carries a second tappet 71 engaged by a rectangular cross-section feed bar 73. It will clearly be seen that movement of the feed bar 73 in the direction of the arrow 74 will drive the tappet lever 76 anticlockwise as shown about the pivot 70, so that the knife 10 is fed in a direction perpendicular to its cutting edge 77.

Each knife is associated with two tappet levers, and in FIG. 4, the second tappet lever 79 is shown in the position which it occupies when the knife 10 has been considerably worn away. In this case, the rear edge of the knife occupies the position 80 and the feed bar has been moved to the position shown by broken lines 82.

Figure 6:
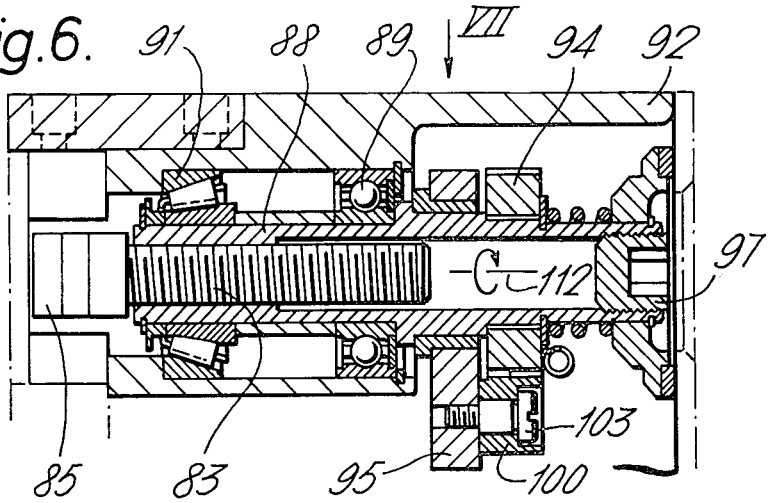
FIG. 6 shows a section (taken on the line VI — VI in FIG. 8) through a feed device associated with one of the knives of the cutter drum shown in FIGS. 3 to 5.
Figure 7:
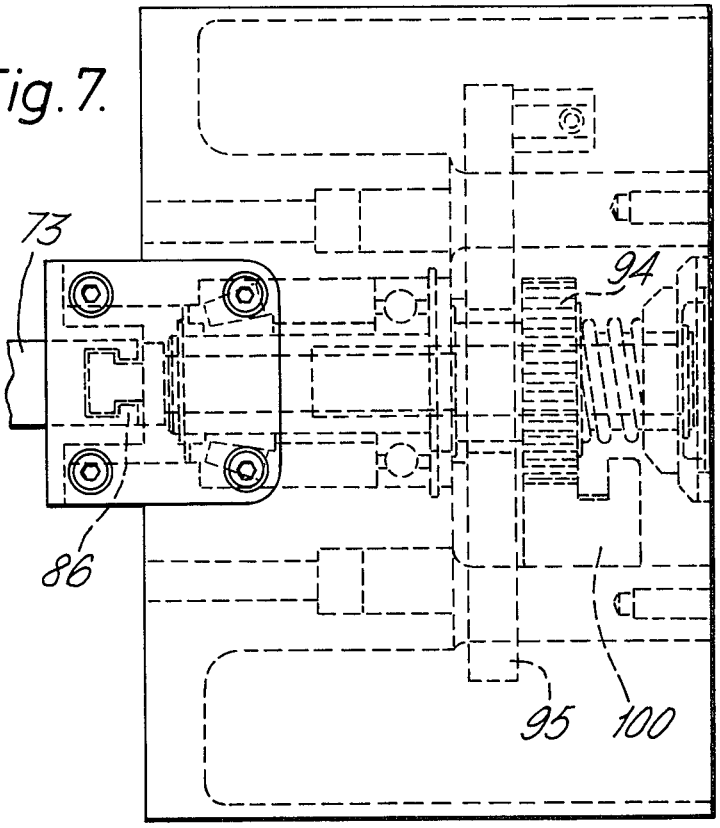
FIG. 7 shows a view taken in the direction of the arrow VII in FIG. 6.

The mechanism for feeding the feed bar 73 as the knife wears away is shown in FIGS. 6 to 8. As seen in FIGS. 7 and 8 a feed screw 83 has a tenon shaped end 85 for non-rotatably engaging the mortice shaped end 86 of the feed bar 73. The feed screw 83 is threaded externally to a hollow shaft 88 supported by bearings 89, 91 within a segment 92 of the cutter drum. The use of a mortice/tenon construction facilitates alignment of the feed bar 73 and the feed screws 83. The shaft 88 has a ratchet wheel 94 mounted in a non-rotatable relationship thereto and a pawl carrying lever 95 freely mounted. The end of the shaft 88 opposite to the feed screw 83 carries a hexagonal socket 97, the purpose of which will be made clear further below.

As shown in FIG. 8, the pawl carrying lever 95 has two pawls 98, 100 mounted thereon by means of screws 101, 103 and by means of a pawl spring 104, the pawls are urged into engagement with the teeth of the ratchet wheel 94. One end of the pawl carrying lever 95 is linked to the piston rod 106 of a piston and cylinder device 107 fed with compressed air from a hollow central passage 109 in the cutter drum via a channel 110.

The knife feed mechanism operates as follows. At the end of each stroke of reciprocation of the grinder carriage a pulse of compressed air is fed to the piston and cylinder device 107. This causes the lever to rotate about the shaft 88 and since the pawls 98, 100 are in engagement with the ratchet wheel, the latter is also caused to rotate in the direction shown by the arrows 112. The shaft 88 is axially fixed in position and therefore rotation of the shaft 88 as the ratchet wheel rotates causes a movement of the feed screw 83 to the right as seen in FIGS. 6 and 7, since the feed screw, by nature of its engagement with the feed bar 73, is unable to rotate. The movement of the feed bar 73 is sufficient to advance the knife 10 by the required amount.

After the compressed air feed pulse to the piston and cylinder device 107, the lever 95 returns under the action of a spring not shown, to a base position determined by an adjuster screw 113. The pawls slide over the teeth of the ratchet wheel 94 into new positions ready for the next advance of the knife.

The advantage of using two pawls 98, 100 as opposed to the one pawl more usual in pawl and ratchet mechanism, is that rotation of the ratchet wheel by half the angular tooth division is possible. Thus in a first feed step the pawl 98 drives the ratchet wheel in the next feed step the pawl 100 drives the ratchet wheel. It is thus possible to advance the knife by smaller steps for the same ratchet wheel.

The hexagonal socket 97 is provided for the insertion of a tool for the purpose of manually adjusting the knife positions, particularly when new knives are being fitted.

Figure 10:
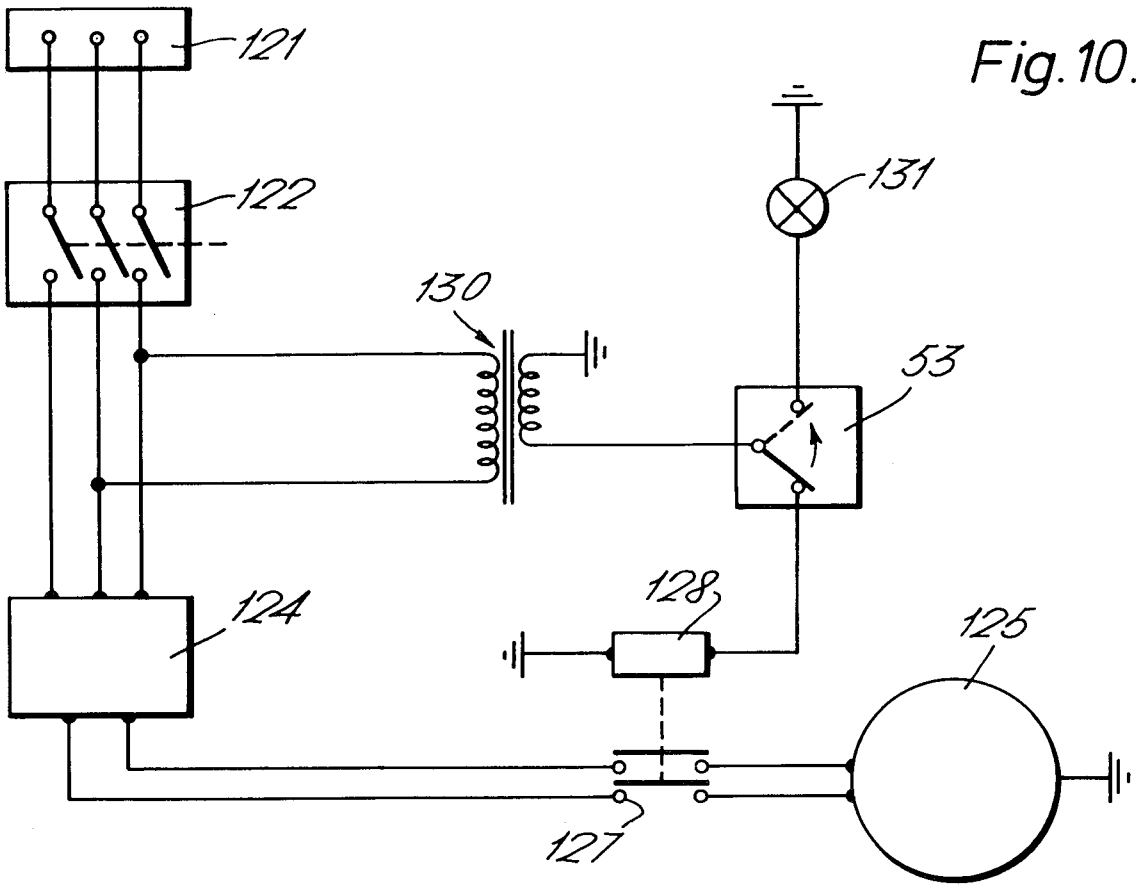
FIG. 10 shows a circuit arrangement for use with the detecting means according to the invention.

As shown in FIG. 10, the circuitry for the cutting machine includes a three phase AC power input 121 which is connected via a main switch 122 to a control circuit 124, the details of which are not shown as they do not concern the present invention. An AC motor 125 is provided to rotate the drum 11 and is connected to the control circuit 124 via the contacts 127 of a relay 128.

The microswitch 53 is supplied with low voltage via a transformer 130 and is connected in series with the coil of the relay 128 in such a manner that only when current is supplied to the relay 128 will the contacts 127 in the circuit of the drum motor 125 be closed.

A warning lamp 131 is connected to the "off" position of the microswitch 53 to be energized when the knife growth detecting device is operated.

Further details of the tobacco cutting machine may be found in copending U.S. application Ser. Nos. 674,252, 674,338 and 674,468 all assigned to the assignee of the present application.

Although but a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. In a cutting machine having a housing, a cutter drum mounted in the housing, a plurality of knives carried on said drum, means for rotating the cutter drum about its axis, means for feeding material to be cut to the cutter drum, means for grinding the knives to maintain a sharp knife edge, means for advancing the knives as they are worn away by the grinding means, a drum diameter being defined by the path of the knife edges as the cutter drum rotates, the provision of a detecting device to detect when a knife has been advanced beyond the cutter drum diameter, said device comprising:

a movable support carried on said housing and movable into and out of a working position;

a detector blade mounted on the movable support and having an edge positioned in proximity to the cutter drum diameter when the movable support is in its working position;

a trip lever connected to the movable support;

a latch mechanism mounted on the housing to retain the trip lever when the movable support is in its working position;

a switch operated by the latch mechanism when the latch mechanism is disengaged by said trip lever; and circuit means for stopping rotation of the cutter drum when said switch means is operated, the arrangement being such that, in use, a knife which has been advanced beyond the cutter drum diameter strikes th detector blade thereby causing the movable support to move out of the working position and the latch mechanism to be disengaged by said trip lever.

2. A cutting machine according to claim 1, in which the movable support is pivotally mounted on the housing.

3. A cutting machine according to claim 2, in which the detector blade has an edge lying in proximity to the cutter drum, the trip lever has an edge engaging the latch mechanism and the movable support is pivotable about a pivot axis parallel to the cutter drum axis and in which the distance between said detector blade edge and said pivot axis is less than the distance between said trip lever edge and said pivot axis.

4. A cutting machine according to claim 1, in which the trip lever has a first end connected to the movable support and a second end provided with a detent for engaging the latch mechanism.

5. A cutting machine according to claim 1, in which the latch mechanism comprises an axially movable trip pin having a first end engaged by said trip lever when the movable support is in its working position, and a spring urging said trip pin into the engaged position.

6. A cutting machine according to claim 5 in which the trip pin has a second end and the switch has a switch operating arm in contact with said trip pin second end.

7. A cutting machine according to claim 1, including means for adjusting the sensitivity of the detecting device.

8. A cutting machine according to claim 7, in which the sensitivity adjusting means includes an adjustable stop screw positioned to contact the trip lever when the movable support is in its working position.

* * * * *